United States Patent [19]

Koehler

[11] 3,987,637

[45] Oct. 26, 1976

[54] METHOD AND APPARATUS FOR TRANSPORTING AND ERECTING AN OFFSHORE TOWER

[75] Inventor: Albert M. Koehler, Houston, Tex.

[73] Assignee: Brown & Root, Inc., Houston, Tex.

[22] Filed: May 6, 1975

[21] Appl. No.: 574,964

[52] U.S. Cl. ..... 61/97; 114/43.5 R; B63C/13/00

[51] Int. Cl.[2] ..... E02B 17/02; B63C 13/00

[58] Field of Search ..... 61/46.5; 114/.5 D, .5 F, 114/43.5

[56] References Cited

UNITED STATES PATENTS

| | | | |
|---|---|---|---|
| 3,754,403 | 8/1973 | Mott et al. | 61/46.5 |
| 3,823,564 | 7/1974 | Crout et al. | 61/46.5 |

FOREIGN PATENTS OR APPLICATIONS

| | | | |
|---|---|---|---|
| 1,487,498 | 5/1967 | France | 61/46.5 |

*Primary Examiner*—Jacob Shapiro

[57] ABSTRACT

A method and apparatus for transporting and erecting an offshore tower jacket is disclosed. The apparatus involves a first pair of elongated buoyancy members which are spaced apart along the lengths thereof and which are operable to float in a horizontal posture on the surface of a body of water. The apparatus further involves a second pair of elongated buoyancy members likewise spaced apart and operable to float in a horizontal posture. The first and second pairs of buoyancy members are themselves maintained in spaced apart relation to one another so that a leg of an offshore tower jacket carried thereby reposes in vertical alignment with the space between the buoyancy members of each pair. A plurality of bridging means serve to interconnect the buoyancy members to maintain the buoyancy members of each pair in the spaced apart relation. The bridging means further serve to carry the offshore tower jacket. To this end, each of the bridging means presents a supportive upper surface which is relatively closely adjacent the waterline when the offshore tower jacket is being carried by the buoyant structure. The jacket is thus carried in a posture minimizing the distance between the center of gravity of the tower and the surface of the body of water relative to that achievable if the buoyancy members were not spaced apart.

The method of the invention involves supporting the offshore tower jacket in a horizontal posture aboard a buoyant structure by cradling at least a portion of a number of the legs of the jacket between pairs of elongated, spaced apart buoyancy members. The legs are thus carried in a condition above, but relatively closely adjacent the surface of the body of water and the distance between the center of gravity of the tower jacket and the surface of the body of water is minimized. The offshore tower jacket being cradled in the manner described, the jacket and buoyant structure can be towed to a desired offshore location and the entire assembly turned upright in the water. Thereafter the tower jacket can be lowered into place on the floor of the body of water and the buoyant structure disconnected therefrom.

2 Claims, 5 Drawing Figures

METHOD AND APPARATUS FOR TRANSPORTING AND ERECTING AN OFFSHORE TOWER

BACKGROUND OF THE INVENTION

The present invention relates generally to a method and apparatus for transporting and erecting the jacket of an offshore tower. More particularly, the invention relates to an improved method and apparatus for safely and efficiently transporting jacket of a large offshore tower to a desired offshore location at which the jacket is placed on the floor of the body of water and the apparatus transporting the jacket recovered for further use.

In the past, towers constructed in the form of a steel space frame have been employed to great advantage in a number of different offshore application. Towers of this sort have been used, for instance, as supports for radar or sonar stations, light beacons, and scientific laboratories. In addition, offshore towers of this type have been often employed by the petroleum industry in operations connected with the drilling, production and distribution of oil and natural gas. The use of offshore towers in the exploration for oil has received increasing emphasis as supplies of petroleum indigenous to the major industrial countries have diminished.

In the past, exploration for oil in offshore environments has been conducted in locations having relatively shallow water. Areas of this type which are productive of oil and gas exist, for instance, along the shores of the Gulf of Mexico. Recently, however, dramatic increases in the price of oil and burgeoning worldwide requirements for energy have made exploration for oil in the geological strata underlying very deep areas of the oceans economically feasible. Indeed, exploration has been conducted to date in water approaching a thousand feet or more in depth. Oil fields submerged in water of this depth may be found, for instance, along the Pacific continental shelf of the United States, in certain arctic regions, and in the North Sea. Exploration of these and other areas having similarly deep water is continuing and indeed exploration is being pressed into ever deeper areas of the oceans.

In order to exploit mineral resources submerged beneath substantial depths of water, towers originally deemed reliable and effective have necessarily been redesigned to sustain prolonged stressing at rather high levels. These newly designed offshore towers are enormous both in terms of size and weight and thus have presented extraordinary challenges in terms of not only mere design, but in terms of the problem of transportation and erection once the tower has been constructed.

In dealing with problems concerning the transportation and erection of offshore towers, considerable attention has been focused on the concept of interiorly segmented tower jacket legs capable of sustaining the jacket in a floating condition as the jacket is towed to a desired offshore location. At the location at which the jacket is to be erected, the compartments formed by the segmented legs are flooded to place the jacket upright on the floor of the body of water.

Considerable attention has also been focused on the concept of a buoyant support which is structurally independent of the offshore tower jacket. In this concept, once the jacket and buoyant structure reach the desired offshore location, the jacket and buoyant structure are disconnected, whereupon the jacket can be placed upright on the floor of the body of water and the buoyant structure recovered for use in connection with other towers. Such an arrangement reduces the weight and surface area of the jacket significantly so that not only is the cost of the tower itself reduced, but the jacket is rendered considerably less vulnerable to hydrodynamic and seismic forces.

Particular advances in the art, in relation to this concept, are afforded by the techniques disclosed in U.S. Pat. Nos. Koehler et al 3,859,804 (Jan. 14, 1975) and Crout et al. 3,823,564 (July 16, 1974) patents, assigned to the assignee of the present invention.

The present invention is directed to improvements of the concept featured in U.S. Pat. Nos. Koehler et al. 3,859,804 (Jan. 14, 1975) and Crout et al. 3,823,564 (July 16, 1974) patents, which improvements:

1. Facilitate the inclusion of pilings with a jacket while the jacket is being towed and installed; and 2. enhance the stability with which a platform jacket is supported by a detachable buoyancy system.

OBJECTS AND SUMMARY OF THE PREFERRED FORMS OF THE INVENTION

In light of the foregoing, it is a general object of the invention to provide a novel method and apparatus for transporting and erecting an offshore tower jacket intended to facilitate the basic objectives as above noted.

Another object of the invention is to provide an innovative method and apparatus for transporting and erecting an offshore tower jacket in which each individual piling jacket of the tower jacket can carry a preassembled piling extending essentially along the entire length of the jacket so as to reduce the magnitude of the logistics problem existing in connection with the supplying of pilings as the jacket is being anchored to the floor of the body of water.

It is still another object of the invention to provide a novel method and apparatus for transporting and erecting an offshore tower jacket wherein the buoyant structure supporting the jacket is configured in such a way that lateral movement of the jacket relative to the buoyant structure is limited to minimize the possibility of the structures becoming separated prematurely.

It is yet still another object of the invention to provide an innovative method and apparatus for transporting and launching an offshore tower jacket in a carefully controlled manner which minimizes danger to personnel, the jacket, and other equipment as the jacket is towed to a desired offshore location and placed upright on the floor of the body of water.

It is a further object of the invention to provide a novel method and apparatus for transporting and erecting an offshore tower jacket in which the jacket and supportive buoyant structure can be readily towed to a desired offshore location.

A still further object of the invention is to provide a novel method and apparatus for erecting an offshore tower jacket wherein the size and complexity of the supportive buoyant structure is substantially reduced.

It is yet still a further object of the invention to provide an innovative method and apparatus for transporting and erecting an offshore tower jacket in which the buoyant supportive structure carrying the jacket can be recovered and thereafter reused in connection with a different tower once the jacket is placed upright on the floor of the body of water.

Yet anther object of the invention is to provide a novel method and apparatus for transporting and erecting an offshore tower jacket in which the supportive buoyant structure carrying the jacket can be quickly and reliably removed from connection with the jacket in a manner minimizing the potential for damage.

Yet still another object of the invention is to provide a novel method and apparatus for transporting and erecting an offshore tower jacket which is highly rugged structurally and which is thus capable of withstanding the forces of heavy seas and winds during the transporting and erecting of the jacket.

A novel apparatus according to the invention preferably is comprised of a first pair of elongated buoyancy members which are spaced apart along their entire lengths and which can be floated in a horizontal posture on the surface of a body of water. The apparatus further involves a second pair of elongated buoyancy members which are also spaced apart along their entire lengths and which are also operable to float in a horizontal posture. The first and second pairs of buoyancy members are spaced apart relative to one another so that a leg of the offshore tower jacket carried by the apparatus reposes in vertical alignment with the space existing between the buoyancy members of a pair. This vertical alignment should exist along substantially the entire length of each leg. A plurality of bridging means are employed to maintain the buoyancy members of each pair in a spaced apart relation and to carry the offshore tower jacket thereon in the horizontal condition mentioned. Each of the bridging means interconnects the buoyancy members of a pair in such a way that the bridging means present supportive upper surfaces to the associated leg of the jacket. These surfaces are relatively closely adjacent the waterline when the offshore tower jacket is being carried. The tower jacket is thus supported in a posture minimizing the distance between the center of gravity of the jacket and the surface of the body of water. This minimization is relative to that achievable if the buoyancy members of each pair were not spaced apart along the entire lengths thereof and the jacket supported above the buoyancy members.

The method of the invention contemplates a number of steps, the first of which involves supporting the tower jacket in a horizontal posture on a buoyant structure by cradling at least a portion of a number of legs between pairs of elongated, spaced apart buoyancy members. The legs are thus supported in a condition above, but relatively closely adjacent the surface of the body of water, and as a result the distance between the center of gravity of the tower jacket and the surface of the body of water is minimized. Once the offshore tower jacket is supported in this manner, the jacket and the supportive buoyant structure can be towed to a desired offshore location. Once the desired offshore location is reached, the entire assembly can be turned upright in the water and the tower jacket thereafter lowered into place on the floor of the body of water. Once the tower jacket is in place on the floor of the body of water, the buoyant structure can be disconnected from the jacket and recovered for use in connection with another tower.

THE DRAWINGS

Other objects and advantages of the invention will become apparent with reference to the detailed description to follow of a preferred embodiment, wherein like reference numerals have been applied to like elements and in which.

DETAILED DESCRIPTION

General Tower Jacket Structure

Figure 1:
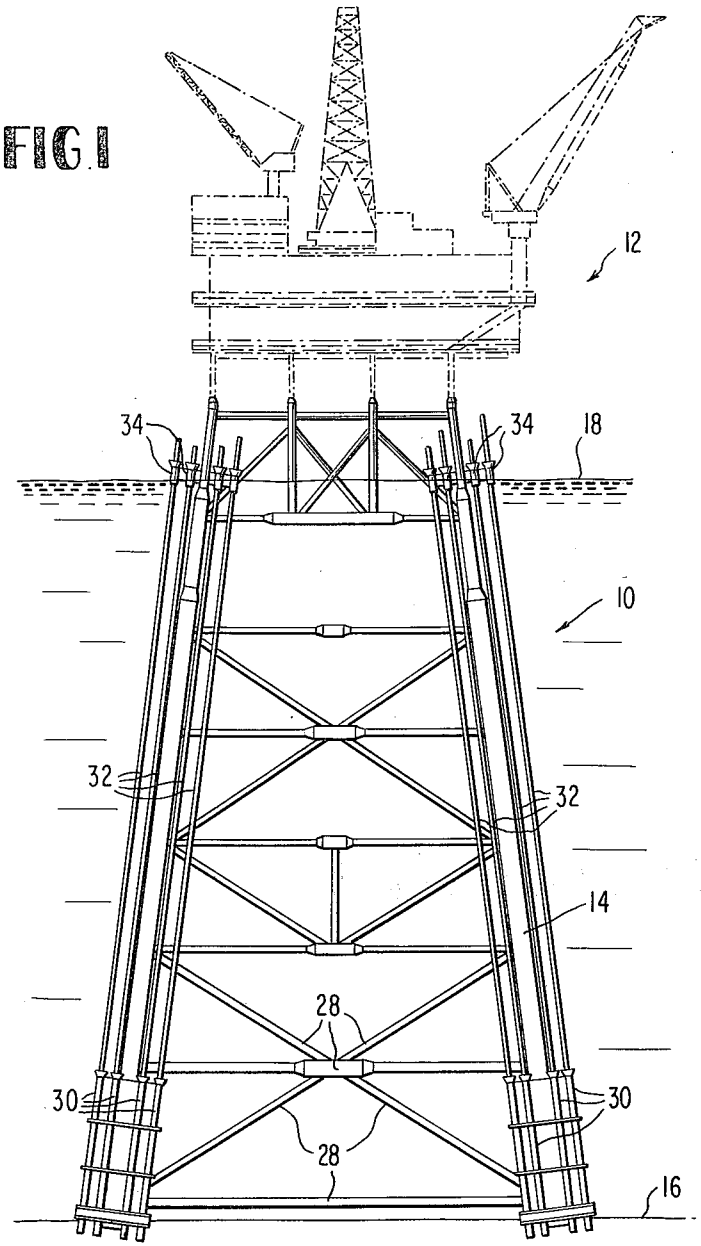
FIG. 1 is a side view of an offshore tower jacket and the initial pilings to be driven in place on the floor of the body of water.

Referring now to the drawings in general and more particularly to FIG. 1 thereof, a typical offshore tower jacket 10 fabricated from steel framing can be seen. The superstructure commonly put in place is shown in phantom at 12. The jacket 10 and superstructure 12 together comprise a complete offshore tower.

The tower jacket 10 includes a plurality of generally upright, supportive legs 14 which extend generally from contact with the floor 16 of the body of water to a position which is elevated somewhat above the surface 18 of the body of water. The legs 14 are dimensioned so that the superstructure 12 is supported at a level sufficiently above the surface of the body of water so that undue contact with waves during stormy weather is avoided. The legs 14 are rigidly interconnected by a plurality of lattices comprised of struts 28. These struts must be designed to withstand lateral loading incident to wind and ocean currents, as well as vertical loading, from the superstructure.

Figure 2:
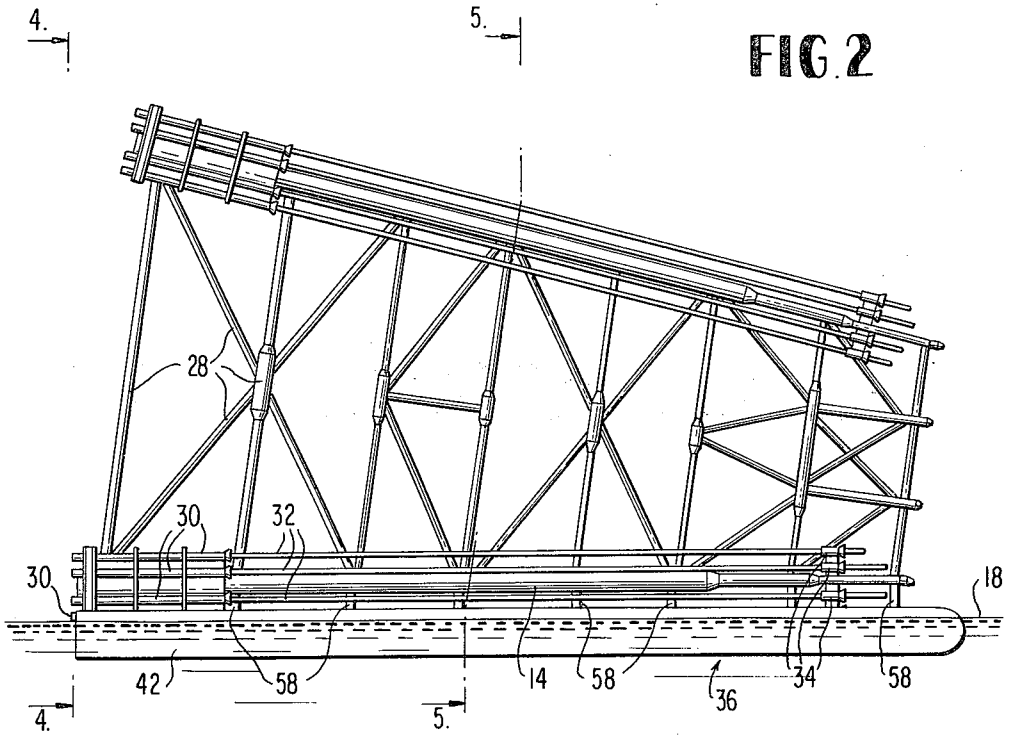
FIG. 2 is a plan view of the tower jacket and the initial pilings to be driven in a supported condition aboard the buoyant structure employed to transport the jacket to a desired offshore location.
Figure 3:
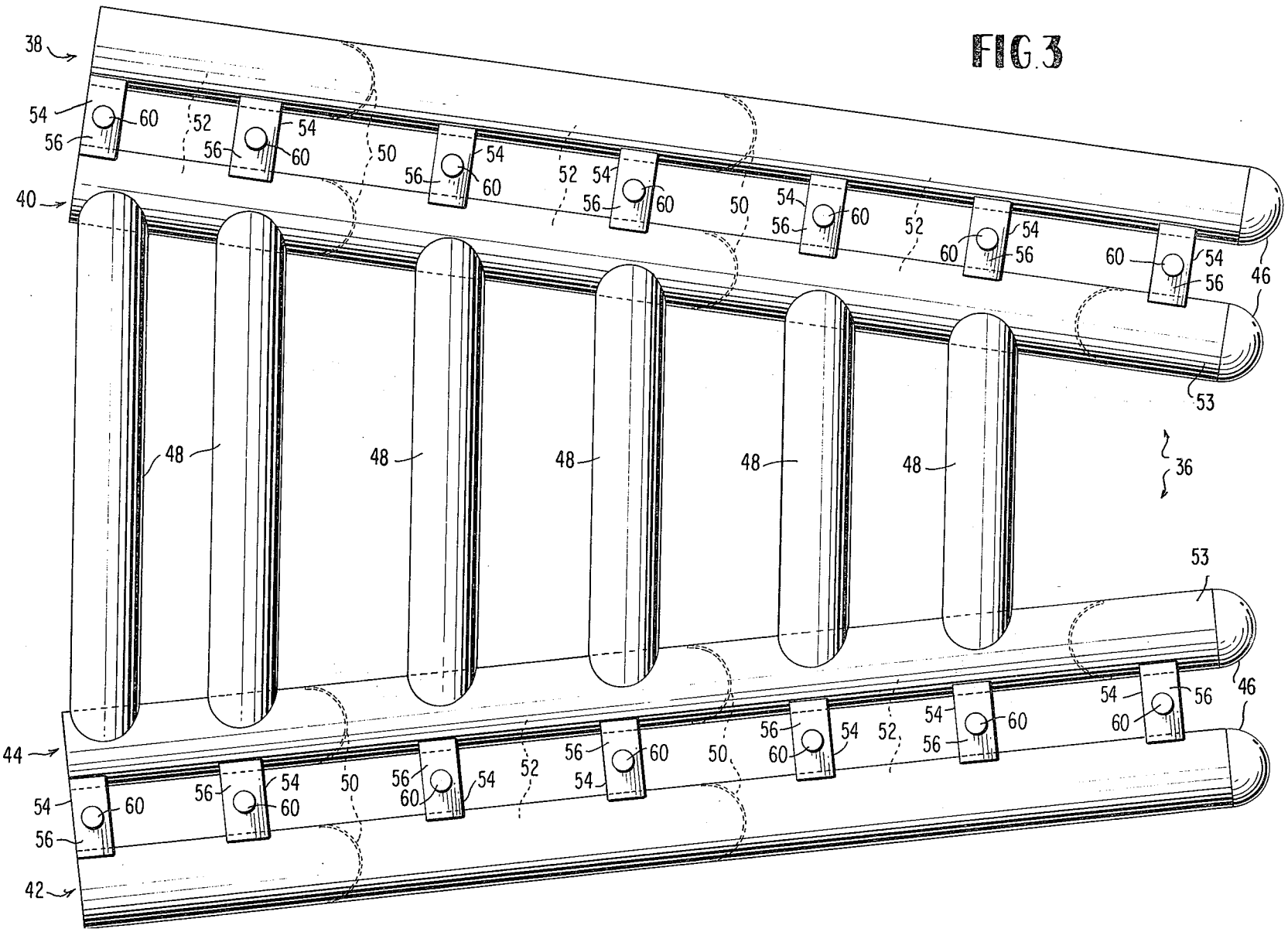
FIG. 3 is a plan view of the buoyant structure employed to transport the tower jacket and initial pilings to a desired offshore location.

The lower ends of the legs of the tower jacket are circumferentially enlarged to carry a plurality of individual piling guides 30. These individual piling guides are attached directly to the lowermost portions of the legs 14 and together carry a plurality of pilings 32 which extend essentially along the entire length of the legs. These pilings 32 are sustained at the upper ends thereof adjacent the portion of the jacket intended to carry the superstructure 12 by a plurality of guiding collars 34. The particular lengths of pilings 32 illustrated in FIG. 1 are commonly made up in the course of the construction of the tower jacket and are detachably secured in place within the guiding collars and individual guides as illustrated in FIG. 1. In this secured condition, the pilings can be transported to the desired offshore location as essentially a part of the tower jacket as illustrated in FIG. 2. This can effect a worthwhile reduction in the logistics problem caused by the need to supply piling to the tower jacket in anchoring the jacket to the floor of the body of water. In other words, to the extent the piling needed to anchor the jacket to the floor of the body of water can be transported along with the jacket, less piling must be carried to the offshore location by service barges. In addition, the preassembly and placement of the initial lengths of piling 32 facilitate the rapid anchoring of the jacket in plae. Addon pilings can be immediately connected to the upper ends of the piling 32 to permit these pilings to be driven into the floor of the body of water.

The diameters of the pilings 32 and the individual piling guides 30 are such that an annular cylindrical volume is formed between the interior surface of the individual piling guides and the exterior surface of the piling associated therewith. Once the piling has been driven a sufficient distance into the strata underlying the tower jacket, this annular volume may be suitably filled with grout to permanently and rigidly connect the pilings and the piling jackets.

It must be emphasized that the tower jacket and superstructure presented in the foregoing are intended to be merely illustrative of the various tower designs currently in use. The present invention is equally suitable for use in connection with various other tower jackets conforming only generally to the structural characteristics of the particular structure first described.

The Jacket Transporting and Erecting Apparatus

A novel apparatus according to a preferred embodiment of the present invention which can be advantageously employed to transport and erect a tower jacket is illustrated in FIGS. 2 through 5.

In particular, the apparatus involves a watertight, buoyant structure 36 which serves to support an offshore tower jacket 10 in an essentially horizontal posture above the surface 18 of the body of water. This quality of the invention is perhaps best illustrated in FIG. 2. As perhaps best illustrated in FIG. 3, the buoyant structure 36 involves a first pair of elongated buoyancy members 38 and 40. These buoyancy members are spaced apart along the entire lengths thereof and as illustrated in FIG. 2, are intended to normally float in a horizontal posture on the surface of the body of water. The buoyant structure further includes a second pair of elongated buoyancy members 42 and 44 which are likewise spaced apart along the entire lengths thereof and which also float in a horizontal posture on the surface of the body of water. The forward ends of these buoyancy members 38, 40, 42, and 44 carry nose portions 46 which serve to streamline the buoyancy members to minimize the resistance offered thereby as the buoyant structure and the tower jacket are towed to a desired offshore location.

Figure 4:
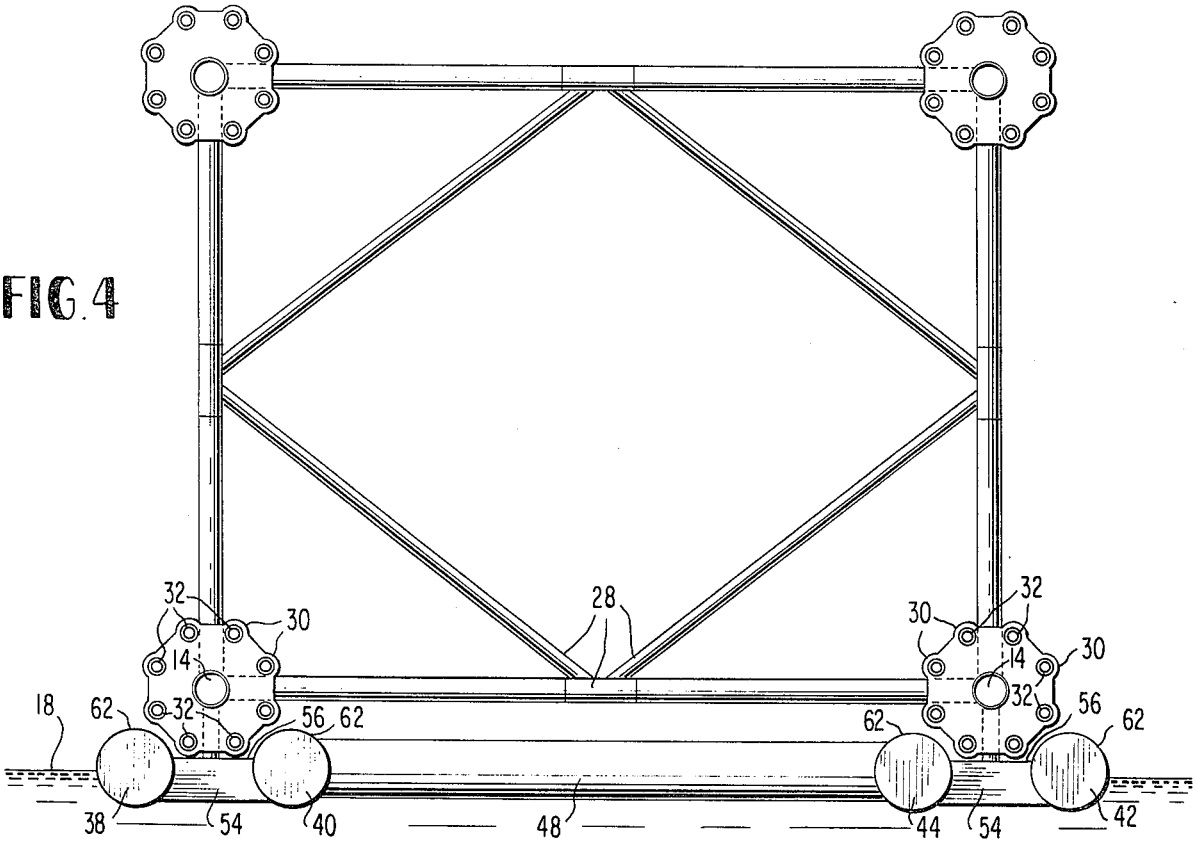
FIG. 4 is a partial sectional view taken along the lines 4—4 of FIG. 2.
Figure 5:
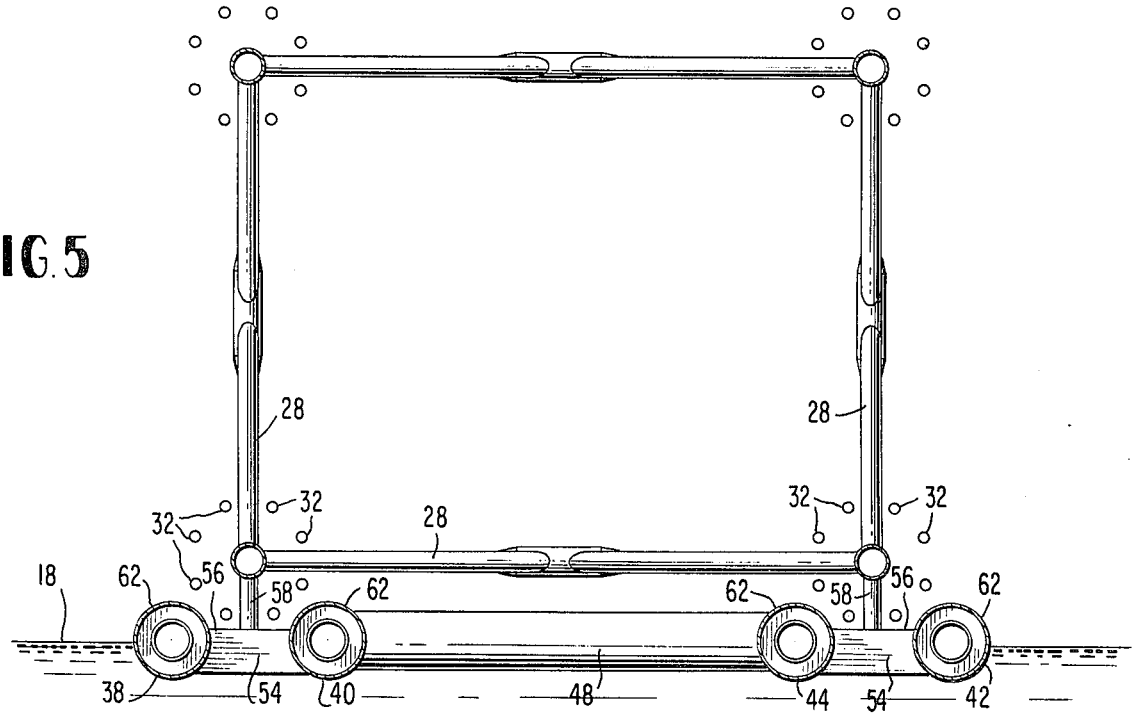
FIG. 5 is a transverse sectional view taken along the lines 5—5 of FIG. 2.

The first and second pairs of buoyancy members are interconnected in a spaced apart relation such that, as illustrated in FIGS. 4 and 5, a leg 14 of the tower jacket reposes in vertical or cradled alignment with the space existing between the buoyancy members 38 and 40 and the buoyancy members 42 and 44. The jacket legs are carried in this posture along substantially the entire length of each of pair of buoyancy members. The pairs of buoyancy members are maintained in this posture by a plurality of elongated buoyancy tanks 48 which rigidly interconnect the pairs of buoyancy members so as to maintain the pairs in a prescribed configuration conforming to the spaced apart relation between the legs 14 of the jacket 10. In other words, the longitudinal dimensions of the elongated buoyancy tanks 48 are such that the axes of the buoyancy members 38 and 40 of the first pair are inclind relative to the longitudinal axes of the buoyancy members 42 and 44 of the second pair. The buoyancy members are so inclined to a degree which is compatible with the degree to which the legs 14 of the jacket are inclined relative to one another. If desired, the buoyancy tanks 48 can be mutally interconnected by suitable buoyancy tanks which may assist in strengthening the overall buoyant structure and which may augment the buoyant capacity of the structure. A preferred arrangement would involve buoyancy members whose axes orthogonally intersect the longitudinal axes of the buoyancy tanks 48.

The buoyancy members 38, 40, 42, and 44 each include a plurality of bulkheads 50 which divide the buoyancy members into a plurality of individual ballast compartments 52. These bulkheads 50 are defined by the broken lines presented in FIG. 3. The individual ballast compartments are selectively ballastable once the buoyant structure and jacket have reached a desired offshore location to turn the buoyant structure and thus the jacket from the horizontal posture illustrated in FIG. 2, to a vertically upright posture in which the jacket rests on the floor of the surround body of water as illustrated in FIG. 1. If desired, the bulkheads 50 of each buoyancy member can be supported structurally by a rigid column coaxially extending through the length of a particular buoyancy member along essentially the entire length thereof. If such a column is employed, the column can also serve as a conduit for carrying various supply lines to each of the ballast compartments 52. The column might further carry various ballasting and deballasting valves and sensory devices so that the quantity and distribution of ballast through the various ballast compartments can be carefully controlled. It should be emphasized that the buoyancy tanks 48, as well as any interconnecting buoyancy members provided, should each be fitted with suitable ballasting and deballasting valves and associated controls.

The ballasting and deballasting of the various ballast compartments of the buoyancy members 38, 40, 42, and 44, as well as the buoyancy tanks 48, can be monitored and controlled by at least one suitable controlling means enclosed within a central control chamber 53 located within the forward end of a buoyancy member. The various instruments housed within the control chamber serve to control the distribution of ballasting material among the ballast compartments and the buoyancy tanks and thus controls the posture in the body of water of the buoyant structure and the jacket carried thereby.

The buoyancy members of each pair are maintained in a prescribed, spaced apart relation by means of a plurality of suitable bridging means preferably in the form of structural bridges 54. The structural bridges also serve to carry the tower jacket in a horizontal condition. As can be appreciated from an examination of FIGS. 3, 4, and 5, the structural bridges interconnect the buoyancy members of each pair in a manner presenting a supportive upper surface 56 which is relatively closely adjacent the surface of the body of water 18 when a tower jacket is being carried by the buoyant structure. Thus, the tower jacket is carried in a posture which minimizes the distance between the center of gravity of the jacket and the surface of the body of water relative to that which could be achieved if the buoyancy members of each pair were not spaced apart along the entire lengths thereof. In other words, as can be appreciated from an examination of FIGS. 4 and 5, the buoyancy members 38 and 40 and 42 and 44 are maintained in spaced apart relation by the structural bridges 54. In maintaining the buoyancy members in spaced apart relation, the structural bridges are configured so that the upper supportive surfaces 56 thereof are relatively closely adjacent, but nonetheless above, the surface 18 of the body of water. It is through these relatively low supportive surfaces that the jacket is supported. If the buoyancy members were not spaed apart as described and if, for instance, the buoyancy members were merely laterally abutted with one another, the size of the buoyancy members would require that the jacket be supported at a higher level in relation to the surface 18 of the body of water than that illustrated in FIGS. 4 and 5. By maintaining the buoyancy members in spaced apart relation along the entire lengths thereof, the center of gravity of the tower can be lowered relative to that achievable if the buoyancy members were not in fact spaced apart. This lowering of the center of gravity should render the combined jacket and buoyant structure more stable and thus more seaworthy.

The lower ends of the legs 14 are somewhat circumferentially enlarged in order to carry a plurality of individual piling jackets and the associated pilings as the jacket is transported to a desired offshore location. It must be emphasized that as illustrated in FIG. 4, the buoyancy members are spaced apart by the structural bridges a distance sufficient that the circumferentially enlarged lower ends of the legs can be received in cradled relation with the buoyancy members. The lower ends are received in this cradled relation in a position which is relatively closely adjacent the upper supportive surface 56 and thus relatively closely adjacent, though nonetheless above, the surface of the body of water. The buoyant structure, employing spaced apart buoyancy members as it does, is well adapted to supporting the tower jacket in a horizontal posture by cradling at least a portion of a number of the legs between pairs of the elongated, spaced apart buoyancy members. Because the legs of the jacket are cradled in this manner, the jacket is carried relatively close to the surface of the body of water so as to minimize the distance between the center of gravity of the jacket and the surface of the body of water.

In order to safely carry the jacket, the jacket must be connected to the buoyant structure 36. In this regard, any suitable mode of connection can be employed. However, it is preferred to employ a plurality of mounting pillars 58 which, as illustrated in FIG. 2, are distributed along the length of the buoyancy members. In particular, the lower portions of these mounting pillars are carried by the structural bridges 54 on the supportive upper surfaces 56 thereof as indicated schematically by the markings 60 shown in FIG. 3. The length of these mounting pillars can be varied to accommodate changes in the diameter of the legs 14 as illustrated in FIG. 2. As can be seen in this figure, as the diameter of the leg 14 decreases, the length of the mounting pillar is increased so that the longitudinal axes of the lower legs extend in a manner which is essentially parallel to the longitudinal axes of the buoyancy members. If desired, certain of the struts 28 illustrated in FIG. 1 can be connected through mounting pillars with the buoyancy tanks 48.

The mounting pillars are generally of a rigid character. However, the two mounting pillars immediately adjacent the stern of the buoyant structure 36 each involve a pivotable assembly which permits the buoyant structure to pivot away from the jacket once the jacket is turned upright and the other mounting pillars severed. Because the particular manner in which the jacket is connected to the buoyant structure does not form a part of the present invention, the mounting pillars have not been discussed in any great detail. Further information can be obtained by examining either U.S. Pat. No. 3,823,564, issued to Jesse V. Crout, et al., or U.S. Pat. No. 3,859,804, issued to Albert M. Koehler, et al. Both of these references are assigned to the assignee of the present application.

Because the legs of the jacket are rigidly connected to the buoyant structure, the jacket can be safely transported to a desired offshore location. The jacket is restrained against movement relative to the buoyant structure by the connection chosen. This restraint may be augmented and rendered more reliable by the fact that at least the intended lower ends of the legs of the jacket are cradled by the buoyancy members, as illustrated in FIGS. 4 and 5, in a manner which limits the movement of the intended lower ends of the jacket in a direction transverse to the longitudinal axes of the buoyancy members. This cradling of the legs to limit movement thus serves to stablize the tower jacket on the buoyant structure so that the jacket is less vulneravble to slipping laterally off of the buoyant structure.

Upon examination of FIGS. 4 and 5 it will be immediately apparent that at least one of the pilings 32 is carried between and below the upper surfaces 62 of the buoyancy members. Thus, as the legs 14 are cradled, at least one of the pilings 32 is also cradled between and below the upper surfaces 62 relatively closely adjacent, but nonetheless above, the surface of the body of water. At the same time, as explained earlier, the distance between the center of gravity of the jacket and the surface of the body of water is minimized. In other words, a full complement of pilings can be carried along with the jacket as the jacket is transported to an offshore location without increasing the distance between the center of gravity of the jacket and the surface of the body of water, and without consequently diminishing the stability or seaworthiness of the assembly. The precise number of pilings which happen to be cradled between the buoyancy members will vary with the chosen design of the jacket. In any case, to the extent a full complement of pilings can be carried, the logistics problems mentioned earlier are reduced.

The Transporting and Erecting of the Jacket

Normally the structures described in the foregoing will be assembled in a suitable graving dock in which the buoyant structure 36 can be rested on a suitable dry bed. The jacket 10 can be assembled directly on and connected to this buoyant structure. Thereafter the graving dock can be flooded to bring the entire assembly to a floating condition. Once the jacket and buoyant structure are floating, the buoyant structure and jacket can be towed to a desired location. Thereafter, the buoyant structure and jacket can be turned upright in the water as a consequence of the selective ballasting of the ballast compartments 52 and the buoyancy tanks 48. Once the jacket and buoyant structure have been turned to an upright condition, the jacket can be lowered into place on the floor of the body of water by further selectively ballasting the ballast compartmenets and the buoyancy tanks. Throughout the operation, the ballasting of the compartments and buoyancy tanks can be manipulated by controlling the flow and distribution of ballasting material to each ballast compartment or buoyancy tank from the control chamber carried within the forward ends of certain of the buoyancy members. Because of the size and number of the ballast compartments and the buoyancy tanks, the ballasting of the buoyant structure and the movement thereof can be relatively accurately and safely controlled. Ultimately, after the jacket has come to rest on the floor of the body of water in the upright condition illustrated in FIG. 1, the buoyant structure can be disconnected therefrom.

The particular manner in which the buoyant structure is ballasted, i.e., the sequence in which the ballast compartments and buoyancy tanks are ballasted, is essentially described in either U.S. Pat. Crout et al. No. 3,823,564 or U.S. Pat. Koehler et al. No. 3,859,804. The manner in which the jacket of the present invention is turned upright in the body of water is conceptually the same as that employed in the two references cited.

SUMMARY OF THE ADVANTAGES OF THE INVENTION

It will be appreciated that, in providing a novel method and apparatus for transporting and erecting an offshore tower jacket upright on the floor of a body of water, certain significant advantages are obtained.

A particular advantage of the invention is that the center of gravity of the jacket is maintained in close proximity to the surface of the body of water in a manner optimizing the seaworthiness of the entire floating structure.

Another advantage of the invention resides in the fact that each individual piling jacket of the tower jacket can carry a preassembled piling extending essentially along the entire length of the jacket to reduce the magnitude of the logistics problem existing in connection with the supply of pilings as the jacket is being erected.

Still another advantage of the invention is afforded by the buoyant structure supporting the offshore tower jacket being configured in such a way that lateral movement of the jacket relative to the buoyant structure is limited to minimize the possibility of the jacket and the buoyant structure being separated prematurely.

Yet still another advantage of the invention is that the transporting and launching of an offshore tower jacket can be conducted in a carefully controlled manner which minimizes danger to personnel, the jacket, and other equipment as the jacket is towed to a desired offshore location and placed upright on the floor of the body of water.

A further advantage of the invention resides in the fact that the tower and supportive buoyant structure can be readily towed to a desired offshore location.

A still further advantage of the invention is that the size and complexity of the supportive buoyant structure is substantially reduced.

Yet still a further advantage of the invention is afforded because the buoyant structure carrying the jacket can be recovered once the jacket is placed upright on the floor of the body of water and can thereafter be reused in connection with a different tower.

Yet another advantage of the invention resides in the fact that the supportive buoyant structure carrying the jacket can be quickly and reliably removed from connection with the jacket in a manner minimizing the potential for damage.

Yet still another advantage of the invention is that the apparatus for transporting and erecting an offshore tower jacket is highly rugged structurally and is thus capable of withstanding the forces of heavy seas and winds during the transporting and erecting of the jacket.

In describing the invention, reference has been made to a preferred embodiment. However, those skilled in the art and familiar with the disclosure of the invention may recognize additions, deletions, substitutions, or other modifications which would fall within the purview of the invention as defined in the claims.

What is claimed is:

1. In combination, an offshore tower jacket and an apparatus for transporting and launching an offshore tower jacket, said combination comprising:

a first pair of elongated buoyancy members spaced apart along the entire length thereof and operable to float in a horizontal posture on the surface of a body of water;

a second pair of elongated buoyancy members spaced apart along the entire lengths thereof and operable to float in a horizontal posture on the surface of a body of water in a spaced apart relation to said first pair of buoyancy members such that a leg of the offshore tower jacket reposes in vertical alignment with the space between said buoyancy members of each pair along substantially the entire length thereof;

a plurality of bridging means for maintaining said buoyancy members of each pair in a prescribed, spaced apart relation and for carrying an offshore tower jacket thereon in a horizontal condition, each of said bridging means interconnecting said buoyancy members of a pair in a manner presenting a supportive upper surface to said legs of the tower jacket relatively closely adjacent the water line when an offshore tower jacket is being carried so that the offshore tower jacket is carried in a posture minimizing the distance between the center of gravity of the jacket and the surface of the body of water relative to that achievable if said buoyancy members of each pair were not spaced apart along the entire lengths thereof;

an offshore tower jacket including jacket legs comprising pile guiding means, a plurality of pile means carried by said pile guiding means;

said outer members, of said first and second pair of elongated buoyancy members defining generally linear, mutually converging, straight outer periphery portions of said apparatus, extending continuously linearly throughout the length of said apparatus; and lowermost ones of said plurality of pile means being nested between and beneath the upper peripheries of said elongated buoyancy members of each of said first and second pair and extending substantially the length of said apparatus.

2. A method for transporting and launching an offshore tower jacket with a tower jacket transporting and launching apparatus, said method comprising:

providing a first pair of elongated buoyancy members spaced apart along the entire length thereof and operable to float in a horizontal posture on the surface of a body of water;

providing a second pair of elongated buoyancy members spaced apart along the entire lengths thereof and operable to float in a horizontal posture on the surface of a body of water in a spaced apart relation to said first pair of buoyancy members such that a leg of the offshore tower jacket reposes in vertical alignment with the space between said buoyancy members of each pair along substantially the entire length thereof; providing a plurality of bridging means for maintaining said buoyancy members of each pair in a prescribed, spaced apart relation and for carrying an offshore tower jacket thereon in a horizontal condition, each of said bridging means interconnecting said buoyancy members of a pair in a manner presenting a supportive upper surface to said legs of the tower jacket relative closely adjacent the water line when an offshore tower jacket is being carried so that the offshore tower jacket is carried in a posture minimizing the distance between the center of gravity of the jacket and the surface of the body of water relative to that achievable if said buoyancy members of each pair were not spaced apart along the entire lengths thereof;

providing an offshore tower jacket including jacket legs comprising pile guiding means a plurality of pile means carried by said pile guiding means;

arranging said outer members, of said first and second pair of elongated buoyancy members to define generally linear, mutually converging, straight outer periphery portions of said apparatus, extending continuously linearly throughout the length of said apparatus; and nesting lowermost ones of said plurality of pile means being nested between and beneath the upper peripheries of said elongated buoyancy members of each of said first and second pair and extending substantially the length of said apparatus.

* * * * *